US005660490A

United States Patent [19]

Warrington

[11] Patent Number: 5,660,490

[45] Date of Patent: Aug. 26, 1997

[54] RING BINDER

[75] Inventor: Glenn Warrington, New Bedford, Mass.

[73] Assignee: U.S. Ring Binder Corporation, New Bedford, Mass.

[21] Appl. No.: 414,950

[22] Filed: Mar. 31, 1995

[51] Int. Cl.[6] ..... B42F 3/04

[52] U.S. Cl. ..... 402/36; 402/41; 402/38; 402/26

[58] Field of Search ..... 402/26, 31, 36, 402/39, 41

[56] References Cited

U.S. PATENT DOCUMENTS

| | | | |
|---|---|---|---|
| 802,403 | 10/1905 | Moore . | |
| 974,831 | 11/1910 | Scherzinger | 402/41 |
| 2,399,561 | 4/1946 | Murphy . | |
| 2,403,851 | 7/1946 | Dawson et al. | 402/39 |
| 2,826,473 | 3/1958 | Hirschle . | |
| 3,205,897 | 9/1965 | Jamison . | |
| 3,270,749 | 9/1966 | O'Connell . | |
| 3,827,111 | 8/1974 | O'Connell . | |
| 4,577,985 | 3/1986 | Beyer . | |
| 4,607,970 | 8/1986 | Heusinkveld . | |
| 4,624,595 | 11/1986 | Ohminato | 402/31 X |
| 4,678,357 | 7/1987 | Kissel et al. | 402/39 |
| 4,792,253 | 12/1988 | Jacobson . | |
| 5,028,159 | 7/1991 | Amrich et al. . | |
| 5,286,128 | 2/1994 | Gillum | 402/39 |

FOREIGN PATENT DOCUMENTS

| | | |
|---|---|---|
| 26 44 405 | 4/1978 | Germany . |
| 955693 | 4/1964 | United Kingdom . |

*Primary Examiner*—Willmon Fridie, Jr.
*Attorney, Agent, or Firm*—Hill, Steadman & Simpson

[57] ABSTRACT

A ring metal for a ring binder having a pair longitudinally arranged leaves partially surrounded an clasped by a resilient metallic shield and a plurality of openable rings having base ends connected to the leaves such that relative angular orientation of the leaves corresponds to an open or closed condition of the rings. By shaping and arranging the rings with respect to the leaves such that the closed condition of the rings corresponds to the relative angular orientation of the leaves being 180° or less measured on a side of the leaves opposite the rings, results in the rings always being urged to the open condition whether open or closed. At least one of the rings provides a hook formation to lock rings halves of at least one ring to lock the rings and leaves in the closed orientation.

6 Claims, 1 Drawing Sheet

"A"
"B"

RING BINDER

BACKGROUND OF THE INVENTION

The present invention relates to ring binders generally, and particularly to ring binders having a plurality of rings arranged on hinged plates or "leaves".

Known ring binder mechanisms have a pair of hinged plates or leaves clapped around their outer side edges by a thin metallic shield having an arquet exposed surface. Three rings are attached to the hinged leaves, each ring comprising two ring halves with base ends connected to the leaves and distal free ends which mate together when the rings are closed. These ring binder mechanisms are referred to in the trade as "ring metals" which are attached, usually by rivets, to a cardboard stock binder cover or the like. Such a ring metal is disclosed for example in U.S. Pat. Nos. 5,116,157; 5,135,323; 5,348,412; and 5,286,128.

However, in the above type ring binder, the hinged leaves become inverted when moving between the closed ring to open ring orientation, and vise versa. In the closed ring orientation, the leaves are angled downwardly away from a center of the shield. The resilient force of the shield urges the rings closed by applying force to the downwardly angled leaves, and this force must be overcome to open the rings i.e., by inverting the angle between the leaves.

SUMMARY OF THE INVENTION

It is an object of the present invention to provide a ring binder which is both easily openable and securely closeable. It is an object of the invention to provide a locking ring metal or binder mechanism which can be opened automatically with very little effort by the consumer.

The objects of the invention are achieved in that a ring metal is provided with a plurality of rings held onto hinged plates or leaves with at least one of the rings having opposed ring halves which have as their distal mating ends, interengageable hook portions for holding the ring together once closed. The hinged leaves are configured to always be in a titled upward position, toward the rings, from the horizontal plane. Due to this configuration, pressure from the shield is always applied to the hinged leaves to urge the rings toward their open position. To open the rings, the ring halves having the hook portions are pushed apart laterally, or twisted apart, with the resulting release causing the pressure from the shield to assist in opening the rings to the complete open position.

DETAILED DESCRIPTION OF THE PREFERRED EMBODIMENTS

Figures 1, 2, 3, 4, 5, 6:
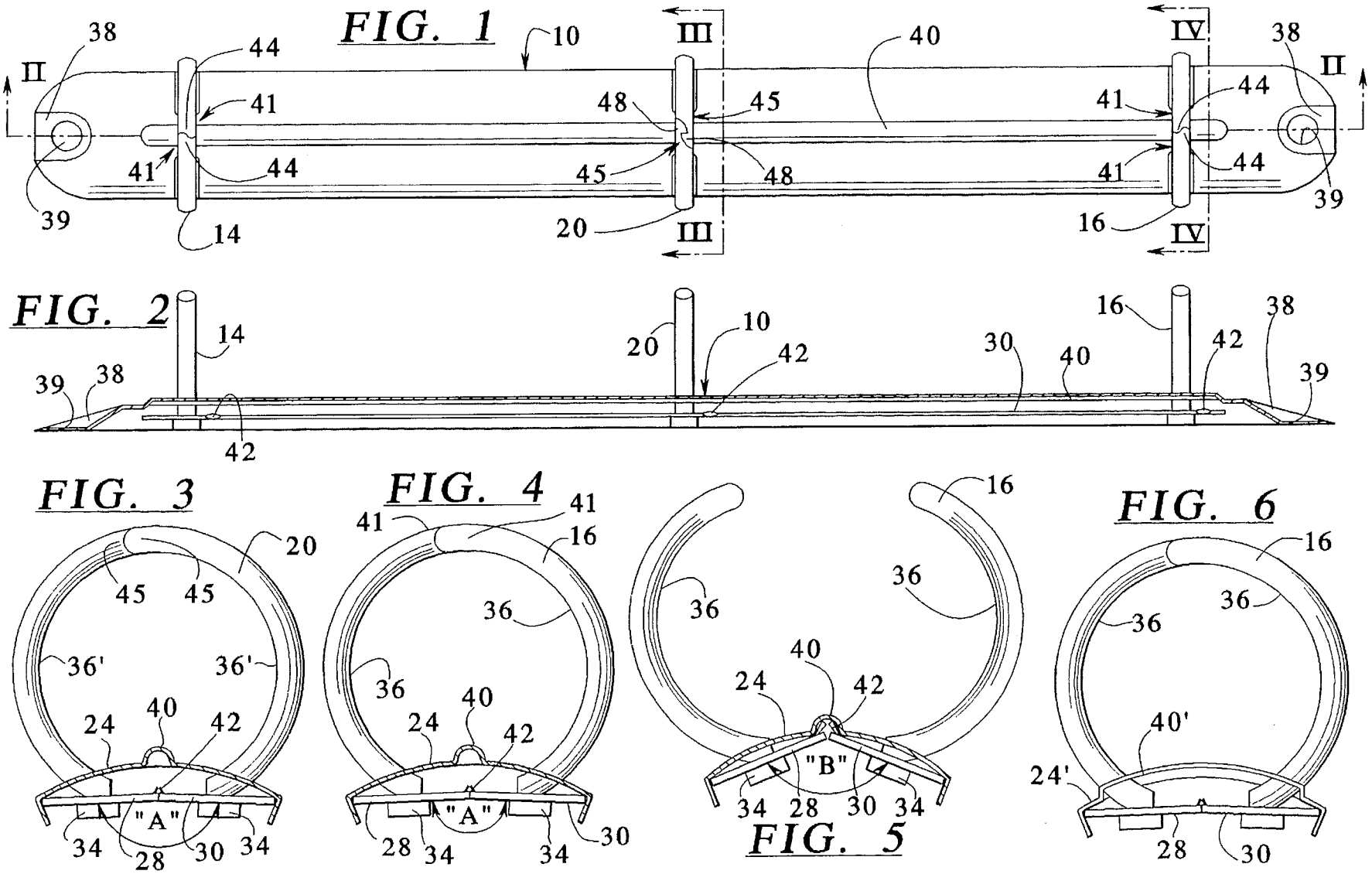
FIG. 1 is a plan view of a ring metal of the present invention.
FIG. 2 is a sectional view taken generally along line II—II of FIG. 1.
FIG. 3 is a sectional view taken generally along line III—III of FIG. 1.
FIG. 4 is a sectional view taken generally along line IV—IV of FIG. 1.
FIG. 5 is a sectional view taken generally along line V—V of FIG. 1.
FIG. 6 is a sectional view of an alternate embodiment ring metal.

FIG. 1 illustrates a ring metal 10 including a first ring 14, a second ring 16, and a third ring 20. The rings are spaced apart and aligned along the ring metal 10. The metal 10 includes a shield 24, such as a resilient thin metallic shield, clasping or partially surrounding two hinged plates or "leaves" 28,30. The rings 14, 16, each have head portion 34 at base ends thereof for holding ring halves 36 to the respective leaves 28,30. The third ring 20 has ring halves 36' having head portions 34 for holding the ring halves 36' to the leaves 28,30.

The shield provides recessed regions 38 having holes 39 for receiving a fastener such as a rivet to hold the ring metal to a binder cover.

The shield 24 provides an upwardly dented region 40. The leaves 28,30 provide interlacing tabs 42 to hingedly interlock leaves 28,30 (as is known from U.S. Pat. No. 5,286,128) for orienting and holding the leaves in hinged condition. These tabs 42 extend upwardly and impact the shield 24 in dented region 40, or at least pass into the dented region 40. The dented region 40 is for the clearance of the tabs to allow the rings to more widely opened than otherwise would be allowable without the dented region 40. The dented region 40 also provides added clasping pressure from the shield 24.

The first and second rings 14, 16 have free ends 41,41 which are provided with wavy regions 44 for interengaging to prevent misalignment of the ring halves 36 once closed, the wavy regions restraining the ring halves 36 in longitudinal direction of the metal 10. The third ring 20 having ring halves 36' has free ends 45,45 having hook portions 48 which interengage to hold the ring halves 36' together to resist differential movement between the ring halves 36' in a direction perpendicular to longitudinal direction, i.e., in a ring opening direction between the ring halves 36' of the third ring 20. To separate the rings halves 36' the ring halves have to be relatively displaced in a longitudinal direction of the ring metal 10, to disengage the hook portions 48,48.

It is noted that in the described embodiment only the center, third ring 20 has the hook portions 48,48, but other rings or all rings could have the hook portions as well.

FIG. 3 and 4 illustrate the ring 16,20 in a closed condition. In the fully closed condition the leaves 28,30 are slightly inclined upwardly toward a center of a shield 24. An angle "A" measured between the leaves 28,30 on a bottom side of the leaves opposite free ends of the rings, is never greater than 180° in the closed ring condition. Thus, the inverted "V" formed by the leaves 28,30 always, at least slightly, points toward the rings. The shield 24 clamped around the leaves 28,30 thus causing a resilient force in a direction against the hinged leaves 28,30 to close the angle "A" (make the angle "A" smaller) and thus urges open the rings. Thus, upon disengagement of the hook portions 48,48, the shield urges the leaves 28,30 to open, or assists in opening, all the rings 14,16,20 as illustrated in FIG. 5.

As shown in FIG. 5, the leaves 28,30 have now assumed a second angle "B". The dent region receives the tabs 42 so that the leaves can fully open within the shield 24.

FIG. 6 shows an alternative embodiment wherein a shield 24' has a larger indented area 40' which, instead of being a central local dent, extends across a majority of the width of the shield 24'. As with the previously disclosed dent 40, this indented area 40' provides an extra space for the tabs 42 to move upwardly and allows the rings to open widely. Additionally, the shield having this indent, increases the resilient interaction against the leaves.

The basic and novel characteristics of the improved methods and apparatus of the present invention will be readily understood from the foregoing disclosure by those skilled in the art. It will become readily apparent that various changes and modifications may be made in the form, construction and arrangement of the improved apparatus of the present invention, and in the steps of the inventive methods hereof, which various respective inventions are as set forth hereinabove without departing from the spirit and scope of such inventions. Accordingly, the preferred and alternative embodiments of the present invention set forth hereinabove are not intended to limit such spirit and scope in any way.

In the claims:

1. A ring metal for a ring binder, comprising:

a first plate and a second plate arranged side by side laterally and extending in a longitudinal direction;

a shield partially surrounding the plates on outer edges thereof, said shield urging said plates together in a lateral direction;

a plurality of pairs of ring halves pairs arranged spaced along said first and second plates and having base ends connected to respectively opposite ones of said first and second plates, and free ends arranged to mate together when said pairs of ring halves are closed, said ring halves closed together when said first and second plates are at a first relative angle and open when said first and second plates are at a second relative angle; wherein said first relative angle is no greater then 180° measured on an opposite side of said plates from said free ends of said ring halves and said angle decreasing as said ring halves are opened from said first relative angle to said second relative angle, said shield urging said plates from said first relative angle toward said second relative angle.

2. The ring metal according to claim 1 wherein at least one of said pairs of ring halves comprises hook elements at said free ends to lock said one of said pairs of ring halves together.

3. In a ring metal for a ring binder having a pair of plates extending longitudinally of the ring metal and arranged hingedly associated together, a resilient shield partially surrounding the plates and urging said plates together, at least one pair of ring halves forming an enclosed ring with the shield when closed, and each ring half having a base end connected to a respective one of said pair of plates, pivotal movement of said plates causing opening of said ring, and free ends mateable together to close the ring, an angle "A" describing the relative angular orientation of one of said plates to the respective other on a side of said plates opposite said free ends of said ring halves, the improvement comprising:

a ring geometry that in the ring closed condition the angle "A" is not greater than 180° so that said ring halves are urged toward the open position by said shield during initial opening from the closed position.

4. The improvement according to claim 3 wherein the angle "A" is less than 180°.

5. The improvement according to claim 3 wherein said free ends of said ring halves are provided with a means for locking the free ends together.

6. The improvement according to claim 3 wherein said free ends of said ring halves are each provided with hook portions for mutual engagement.

* * * * *